US007899361B2

(12) United States Patent
Kwon

(10) Patent No.: US 7,899,361 B2
(45) Date of Patent: Mar. 1, 2011

(54) PHOTOSENSITIVE MEDIUM SUPPORTING APPARATUS, DEVELOPING CARTRIDGE AND IMAGE FORMING APPARATUS HAVING THE SAME AND METHOD TO ASSEMBLE AND DISASSEMBLE A DEVELOPING CARTRIDGE

(75) Inventor: Young-ki Kwon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 465 days.

(21) Appl. No.: 11/971,326

(22) Filed: Jan. 9, 2008

(65) Prior Publication Data

US 2008/0240777 A1 Oct. 2, 2008

(30) Foreign Application Priority Data

Mar. 27, 2007 (KR) ..... 10-2007-0029986

(51) Int. Cl.
*G03G 15/00* (2006.01)

(52) U.S. Cl. ..... 399/117; 399/111

(58) Field of Classification Search ..... 399/111, 399/117

See application file for complete search history.

(56) References Cited

U.S. PATENT DOCUMENTS

| | | | | | |
|---|---|---|---|---|---|
| 5,457,520 | A * | 10/1995 | Schell et al. | ..... | 399/117 |
| 5,854,955 | A * | 12/1998 | Yawata et al. | ..... | 399/111 |
| 6,072,968 | A * | 6/2000 | Nomura et al. | ..... | 399/113 |
| 6,157,797 | A * | 12/2000 | Saito et al. | ..... | 399/107 |
| 6,249,661 | B1 * | 6/2001 | Saitoh et al. | ..... | 399/117 |
| 6,301,458 | B1 * | 10/2001 | Mori et al. | ..... | 399/167 |
| 6,490,426 | B1 * | 12/2002 | Zaman | ..... | 399/117 |
| 7,082,274 | B2 * | 7/2006 | Saitoh et al. | ..... | 399/110 |
| 2002/0025188 | A1 * | 2/2002 | Otani et al. | ..... | 399/117 |

FOREIGN PATENT DOCUMENTS

| | | |
|---|---|---|
| JP | 08320634 | 12/1996 |
| KR | 1996-35173 | 10/1996 |

* cited by examiner

*Primary Examiner* — David M Gray
*Assistant Examiner* — G. M. Hyder
(74) *Attorney, Agent, or Firm* — Stanzione & Kim, LLP

(57) ABSTRACT

A photosensitive medium supporting apparatus includes a supporting shaft to rotatably support a photosensitive medium and to have a fixing groove or a fixing projection formed at one portion of the supporting shaft that projects from one end of the photosensitive medium, a first shaft supporting member to support the one portion of the supporting shaft that projects from one end of the photosensitive medium and to have a fixing projection or a fixing groove that is inserted into the fixing groove or the fixing projection of the supporting shaft, and a second shaft supporting member to support an other portion of the supporting shaft that projects from the other end of the photosensitive medium.

32 Claims, 9 Drawing Sheets

PHOTOSENSITIVE MEDIUM SUPPORTING APPARATUS, DEVELOPING CARTRIDGE AND IMAGE FORMING APPARATUS HAVING THE SAME AND METHOD TO ASSEMBLE AND DISASSEMBLE A DEVELOPING CARTRIDGE

CROSS-REFERENCE TO RELATED APPLICATIONS

This application claims priority under 35 U.S.C. §119(a) from Korean Patent Application No. 2007-29986 filed Mar. 27, 2007 in the Korean Intellectual Property Office, the disclosure of which is incorporated herein by reference in its entirety.

BACKGROUND OF THE INVENTION

1. Field of the Invention

The present general inventive concept relates to an image forming apparatus. More particularly, the present general inventive concept relates to a photosensitive medium supporting apparatus to support a photosensitive medium, a developing cartridge and an image forming apparatus having the same, and methods to assemble and disassemble a developing cartridge.

2. Description of the Related Art

Generally, image forming apparatuses are provided with a photosensitive medium on which predetermined electrostatic latent images are formed. The photosensitive medium is disposed to rotate with respect to a supporting shaft fixed to an image forming apparatus. That is, the supporting shaft is disposed through a center of the photosensitive medium to have a substantially cylindrical shape so that photosensitive medium can rotate with respect to the supporting shaft.

Furthermore, at one end of the photosensitive medium is disposed a gear to rotate integrally with the photosensitive medium with respect to the supporting shaft. As a result, when the photosensitive medium is disposed at the image forming apparatus, the gear of the photosensitive medium receives power from a drive gear disposed in a main body so that the photosensitive medium rotates with respect to the supporting shaft.

At this time, to allow the photosensitive medium to maintain a predetermined position with respect to the image forming apparatus, the supporting shaft needs to be fixed not to rotate together with the photosensitive medium and move in an axial direction of the photosensitive medium.

For this, in conventional image forming apparatuses, a fixing ring is disposed at the supporting shaft so as to prevent the supporting shaft from moving in an axial direction of the photosensitive medium, and at least one set of screws are used to fix the supporting shaft to a supporting member to prevent the supporting shaft from rotating together with the photosensitive medium.

As described above, to use separate parts for the prevention of a rotation of the supporting shaft and an axial direction movement of the supporting shaft needs a lot of parts making it inconvenient to assembly.

SUMMARY OF THE INVENTION

The present general inventive concept has been developed in order to overcome the above drawbacks and other problems associated with the conventional arrangement. An aspect of the present general inventive concept is to provide a photosensitive medium supporting apparatus that does not use separate parts and can prevent a supporting shaft to support a photosensitive medium from moving in an axial direction and rotating, a developing cartridge and an image forming apparatus having the same, and methods to assemble and disassemble the developing cartridge.

Additional aspects and utilities of the present general inventive concept will be set forth in part in the description which follows and, in part, will be obvious from the description, or may be learned by practice of the general inventive concept.

The foregoing and/or other aspects and utilities of the of the generals present inventive concept may be achieved by providing a rotation body supporting apparatus, which includes a supporting shaft to rotatably support a rotation body and to have a fixing groove formed at one portion of the supporting shaft that projects from one end of the rotation body, a first shaft supporting member to support the one portion of the supporting shaft that projects from the one end of the rotation body and to have a fixing projection that is inserted into the fixing groove of the supporting shaft, and a second shaft supporting member to support an other portion of the supporting shaft that projects from the other end of the rotation body.

The foregoing and/or other aspects and utilities of the general inventive concept may also be achieved by providing a photosensitive medium supporting apparatus usable with a developing cartridge, the apparatus including one of a supporting shaft to rotatably support a photosensitive medium and to have a fixing groove and a fixing projection formed at one portion of the supporting shaft that projects from one end of the photosensitive medium, a first shaft supporting member to support the one portion of the supporting shaft that projects from the one end of the photosensitive medium and to have one of a fixing projection and a fixing groove that is inserted into the fixing groove or the fixing projection of the supporting shaft, and a second shaft supporting member to support the other portion of the supporting shaft that projects from the other end of the photosensitive medium.

The supporting shaft may further include one of a second fixing groove and a second fixing projection formed below the fixing groove or the fixing projection, and the first shaft supporting member may further include one of a second fixing projection and a second fixing groove that is inserted into the second fixing groove or the second fixing projection of the supporting shaft.

The foregoing and/or other aspects and utilities of the general inventive concept may also be achieved by providing a developing cartridge of an image forming apparatus including a supporting shaft to rotatably support a photosensitive medium and to have a fixing groove formed at one portion of the supporting shaft that projects from one end of the photosensitive medium, a frame to have a photosensitive medium hole through which some portion of the photosensitive medium is exposed, a first shaft supporting member disposed inside the frame to support the one portion of the supporting shaft that projects from the one end of the photosensitive medium and to have a fixing projection that is inserted into the fixing groove of the supporting shaft, and a second shaft supporting member disposed inside the frame to face the first shaft supporting member to support an other portion of the supporting shaft that projects from the other end of the photosensitive medium.

The photosensitive medium may include a photosensitive drum formed in a substantially hollow cylindrical shape, a first flange disposed at one end of the photosensitive drum, and to have a through hole into which the supporting shaft is inserted, and a second flange disposed at an other end of the photosensitive drum, and to have a gear formed on an outer circumferential surface of the second flange and a through hole into which the supporting shaft is inserted.

Each of the first and second flanges may include a projection portion formed on a side of each of the first and second flanges to contact each of the first and second shaft supporting members.

The foregoing and/or other aspects and utilities of the general inventive concept may also be achieved by providing a developing cartridge usable with an image forming apparatus, the developing cartridge including a supporting shaft to rotatably support a photosensitive medium and to have a fixing groove formed at one portion of the supporting shaft that projects from one end of the photosensitive medium, a used toner collecting frame unit to have first and second shaft supporting members that are formed to support both portions of the supporting shaft to project from both ends of the photosensitive medium, a fixing projection formed at the first shaft supporting member to be inserted into the fixing groove of the supporting shaft, a toner supply frame unit disposed opposite to the used toner collecting frame unit with respect to the photosensitive medium, and first and second side plates disposed at both sides of the used toner collecting frame unit and the toner supply frame unit.

The toner supply frame unit may include first and second coupling members that are formed to support the both portions of the supporting shaft to project from both ends of the photosensitive medium outside the first and second shaft supporting members of the used toner collecting frame unit.

The developing cartridge of the image forming apparatus may further include a charging roller unit disposed above the photosensitive medium between the used toner collecting frame unit and the toner supply frame unit.

The foregoing and/or other aspects and utilities of the general inventive concept may also be achieved by providing an image forming apparatus including a printing medium feeding unit to supply a printing medium, and a developing cartridge to form images corresponding to printing data, the developing cartridge comprising a supporting shaft to rotatably support a photosensitive medium and to have a fixing groove formed at one portion of the supporting shaft that projects from one end of the photosensitive medium, a frame to have a photosensitive medium hole through which a portion of the photosensitive medium is exposed, a first shaft supporting member disposed inside the frame to support the one portion of the supporting shaft that projects from the one end of the photosensitive medium and to have a fixing projection that is inserted into the fixing groove of the supporting shaft, and a second shaft supporting member disposed inside the frame to face the first shaft supporting member to support an other portion of the supporting shaft that projects from an other end of the photosensitive medium, a transferring roller rotatably disposed to contact the photosensitive medium to transfer the image formed on the photosensitive medium onto a printing medium supplied from the printing medium feeding unit, and a discharging unit to discharge the printing medium having the images formed thereon.

The foregoing and/or other aspects and utilities of the general inventive concept may also be achieved by providing a method to assemble a developing cartridge of an image forming apparatus, the method including inserting a supporting shaft into a photosensitive medium so that a fixing groove of the supporting shaft is exposed outside one end of the photosensitive medium, inserting the fixing groove of the supporting shaft into a fixing projection of a used toner collecting frame unit so that the supporting shaft with the photosensitive medium is assembled with the used toner collecting frame unit, installing a toner supply frame unit opposite to the used toner collecting frame unit with respect to the photosensitive medium, installing a charging roller unit above the photosensitive medium between the used toner collecting frame unit and the toner supply frame unit, and assembling first and second side plates at both sides of the used toner collecting frame unit and the toner supply frame unit.

The foregoing and/or other aspects and utilities of the general inventive concept may also be achieved by providing a method to disassemble a developing cartridge of an image forming apparatus, the method including separating first and second side plates from the developing cartridge, separating a charging roller unit, separating a toner supply frame unit from a used toner collecting frame unit, separating a fixing groove of a supporting shaft from a fixing projection of the used toner collecting frame unit so that the supporting shaft with a photosensitive medium is separated from the used toner collecting frame unit, and separating the supporting shaft from the photosensitive medium.

The foregoing and/or other aspects and utilities of the general inventive concept may also be achieved by providing a photosensitive medium for a developing cartridge detachably mounted to an image forming apparatus, the photosensitive medium including a supporting shaft to rotatably support the photosensitive medium, to project from both ends of the photosensitive medium, and to have a fixing groove, wherein the fixing groove is formed at one portion of the supporting shaft that projects from one end of the photosensitive medium to be inserted into a fixing projection of a first shaft supporting member disposed at the developing cartridge.

The foregoing and/or other aspects and utilities of the general inventive concept may also be achieved by providing a supporting shaft usable with a developing cartridge detachably mounted to an image forming apparatus, including two portions at opposite ends of the supporting shaft to project from two ends of a photosensitive medium of the developing cartridge and to be supported by first and second shaft supporting members that are disposed at the developing cartridge; and a fixing groove formed at one portion of the supporting shaft that projects from one end of the photosensitive medium to be inserted into a fixing projection of the first shaft supporting member, wherein when the fixing groove of the supporting shaft is inserted into the fixing projection of the first shaft supporting member, the supporting shaft is fixed with respect to the first and second shaft supporting members to rotatably support the photosensitive medium.

The foregoing and/or other aspects and utilities of the general inventive concept may also be achieved by providing a frame for a developing cartridge detachably mounted to an image forming apparatus, the frame including first and second shaft supporting members to support a supporting shaft, wherein the supporting shaft projects from both ends of a photosensitive medium of the developing cartridge and has a fixing groove formed at one portion of the supporting shaft to project from one end of the photosensitive medium, and wherein the first shaft supporting member has a fixing projection formed to be inserted into the fixing groove of the supporting shaft.

The foregoing and/or other aspects and utilities of the general inventive concept may also be achieved by providing a developing apparatus usable with an image forming apparatus, including a photosensitive medium having opposite ends, a supporting shaft to rotatably support the photosensitive medium and having two end portions, each of the two end portions of the supporting shaft extending pass the opposite ends of the photosensitive medium, respectively, and at least one of the two end portions having one of at least one fixing groove and at least one fixing projection to interconnect with an other of the at least one fixing groove and the at least one fixing projection of the image forming apparatus.

The foregoing and/or other aspects and utilities of the general inventive concept may also be achieved by providing an image forming apparatus, including a frame including a shaft supporting member having at least one of a fixing groove and a fixing projection, and a developing apparatus, including a photosensitive medium having opposite ends, a supporting shaft having two end portions and to rotatably support the photosensitive medium, each of the two end portions of the supporting shaft extending pass the opposite ends of the photosensitive medium, respectively, and at least one of the two end portions having an other of the one fixing groove and the one fixing projection to interconnect with the at least one of the fixing groove and the fixing projection of the frame.

The foregoing and/or other aspects and utilities of the general inventive concept may also be achieved by providing a developing apparatus including a photosensitive drum having a gear formed on a surface thereof and a hole formed therein in a rotation axis thereof, a shaft rotatably inserted in the hole, having a first end having a groove, and having a second end, and a frame including a first shaft supporting member having a first supporting groove to correspond to the groove of the first end and having a second supporting groove to correspond to the second end.

Other aspects, advantages and salient features of the general inventive concept will become apparent from the following detailed description, which, taken in conjunction with the annexed drawings, discloses embodiments of the general inventive concept.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which:

FIG. 6 is a perspective view illustrating a supporting shaft that is about to be inserted into a photosensitive medium according to an embodiment of the present general inventive concept;

FIG. 7 is a perspective view illustrating a supporting shaft with a photosensitive medium that is about to be assembled to a used toner collecting frame unit according to an embodiment of the present general inventive concept;

FIG. 8 is a perspective view illustrating a toner supply frame unit that is about to be assembled to a used toner collecting frame unit with a photosensitive medium according to an embodiment of the present general inventive concept;

FIG. 9 is a perspective view illustrating a charging roller unit that is about to be assembled to a subassembly of a used toner collecting frame unit and a toner supply frame unit according to an embodiment of the present general inventive concept;

FIG. 10 is a perspective view illustrating first and second side plates that are about to be assembled to a subassembly of a used toner collecting frame unit, a toner supply frame unit, and a charging roller unit according to an embodiment of the present general inventive concept;

FIG. 11 is a perspective view illustrating a developing cartridge of an image forming apparatus according to an embodiment of the present general inventive concept that is completely assembled through processes of FIGS. 6 to 10;

Throughout the drawings, like reference numerals will be understood to refer to like parts, components and structures.

DETAILED DESCRIPTION OF THE PREFERRED EMBODIMENTS

Figure 1:
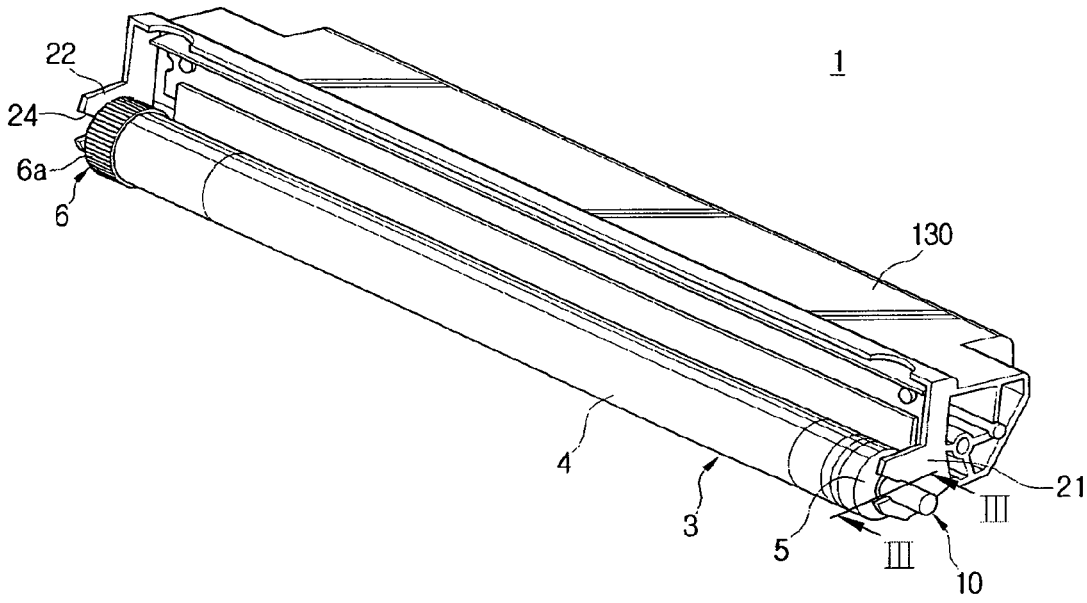
FIG. 1 is a perspective view illustrating a photosensitive medium supporting apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

The matters defined in the description, such as a detailed construction and elements thereof, are provided to assist in a comprehensive understanding of the general inventive concept. Thus, it is apparent that the present general inventive concept may be carried out without those defined matters. Also, well-known functions or constructions are omitted to provide a clear and concise description of exemplary embodiments of the present general inventive concept.

FIG. 1 is a perspective view illustrating a photosensitive medium supporting apparatus according to an embodiment of the present general inventive concept.

Referring to FIG. 1, a photosensitive medium supporting apparatus 1 according to an embodiment of the present general inventive concept includes a photosensitive medium 3, a supporting shaft 10, and first and second shaft supporting members 21 and 22.

The photosensitive medium 3 rotates with respect to the supporting shaft 10, and predetermined images are formed on a surface of the photosensitive medium 3. The photosensitive medium 3 includes a photosensitive drum 4 that has a substantially hollow cylindrical shape and a photoconductive layer on a surface thereof, and first and second flanges 5 and 6 that are coupled to both ends of the photosensitive drum 4. The photosensitive medium 3 has a similar structure as that of a photosensitive medium 110 of an image forming apparatus illustrated in FIG. 13.

A gear 6*a* is formed at an outer circumferential surface of the second flange 6 and is meshed with a drive gear 303 (FIG. 13) disposed in the image forming apparatus to receive power. A through hole 5*c* into which the supporting shaft 10 is inserted is formed at a center of each of the first and second flanges 5 and 6. The through holes 5*c* are formed so that the first and second flanges 5 and 6 can smoothly rotate with respect to the supporting shaft 10. A projection portion 5*b* may be formed on a side surface of each of the first and second flanges 5 and 6 that face outside. The projection portions 5*b* may minimize an area of a contacting portion on which each of the first and second flanges 5 and 6 of the photosensitive medium 3 contacts each of the first and second shaft supporting members 21 and 22 when the photosensitive medium 3 rotates. In addition, the first and second flanges 5 and 6 are fixed to opposite ends of the photosensitive drum 4 by a coupling method using elasticity of the flanges 5 and 6, adhesion, etc. Therefore, the first and second flanges 5 and 6 rotate integrally with the photosensitive drum 4.

Figure 2:
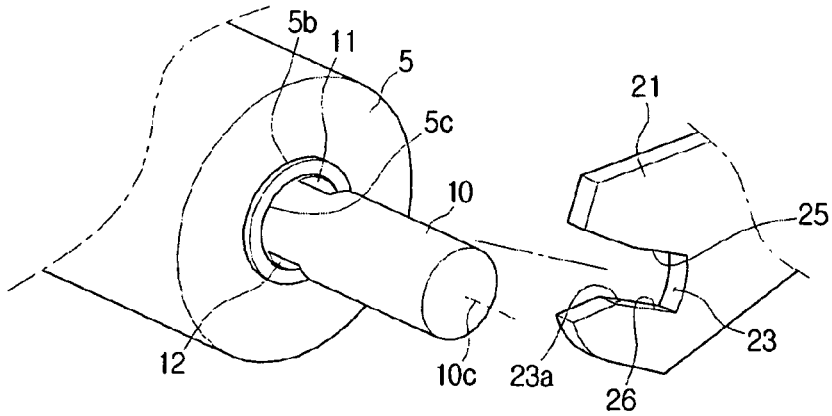
FIG. 2 is a perspective view illustrating a supporting shaft of the photosensitive medium supporting apparatus of FIG. 1 to be inserted into a fixing projection of a first shaft supporting member.

The supporting shaft 10 is disposed through a center of the photosensitive medium 3 in an axial direction of the photosensitive medium 3. The supporting shaft 10 has a substantially circular section and is longer than the photosensitive medium 3. Therefore, the supporting shaft 10 is inserted into the photosensitive medium 3 so that portions near opposite ends of the supporting shaft 10 projects from both ends of the photosensitive medium 3. A fixing groove 11 is formed at one portion of the supporting shaft 10 that projects from one end of the photosensitive medium 3 near the one end of the photosensitive medium 3, that is, the first flange 5. The fixing groove 11 is formed substantially parallel to the first flange 5 to form the one end of the photosensitive medium 3. That is, the fixing groove 11 is formed to extend over the width of the supporting shaft 10 perpendicular to a center axis 10*c* of the supporting shaft 10. The fixing groove 11 has a substantially square section and a depth t smaller than a dimension of a radius of the supporting shaft 10. Accordingly, a dimension of the depth t of the fixing groove 11 may be determined so that the fixing groove 11 and a fixing projection 25 to be inserted into the fixing groove 11 prevent the supporting shaft 10 from rotating with respect to the first and second shaft supporting members 21 and 22 or moving in an axial direction of the photosensitive medium 4. Also, a second fixing groove 12 may be formed to be substantially symmetric with respect to the center axis 10*c* of the supporting shaft 10 on the supporting shaft 10 under the fixing groove 11. That is, as illustrated in FIG. 2, the supporting shaft 10 has a pair of fixing grooves 11 and 12 that is formed at upper and lower portions of the supporting shaft 10 parallel with each other in a direction perpendicular to the supporting shaft 10. The second fixing groove 12 may be formed in substantially a same size as that of the fixing groove 12.

Figure 4:
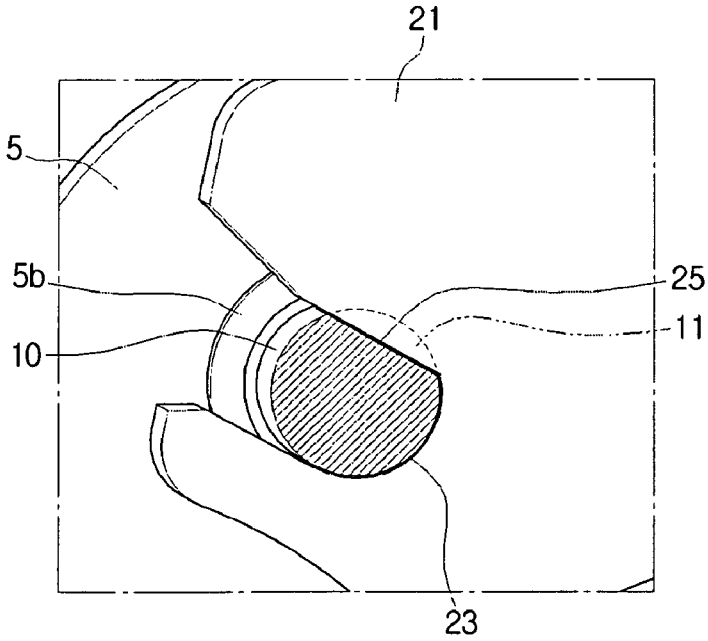
FIG. 4 is a partially cut-out, perspective view illustrating a supporting shaft with one fixing groove to be inserted into a first shaft supporting member with one fixing projection in a photosensitive medium supporting apparatus according to an embodiment of the present general inventive concept.

In the above description, the supporting shaft 10 has two fixing grooves 11 and 12 that are formed vertically. Alternatively, the supporting shaft 10 can have only one fixing groove 11 as illustrated in FIG. 4. Accordingly, the first shaft supporting member 21 has only one fixing projection 25.

Furthermore, in this embodiment, the pair of fixing grooves 11 and 12 is formed at the portion of the supporting shaft 10 to project from the one end of the photosensitive medium 3. Alternatively, two pair of fixing grooves 11 and 12 may be formed at both portions of the supporting shaft 10 to project from both ends of the photosensitive medium 3.

The first and second shaft supporting members 21 and 22 support the both portions of the supporting shaft 10 to project from both ends of the photosensitive medium 3, and prevent the supporting shaft 10 from rotating with respect to the photosensitive medium 3 or moving in an axial direction of the photosensitive medium 3. The first and second shaft supporting members 21 and 22 may be disposed at a frame of the developing cartridge or a main body of the image forming apparatus according to an installation method of the photosensitive medium. FIG. 1 illustrates the first and second shaft supporting members 21 and 22 that are disposed at a used toner collecting frame 130 of a developing cartridge 100.

Figure 3:
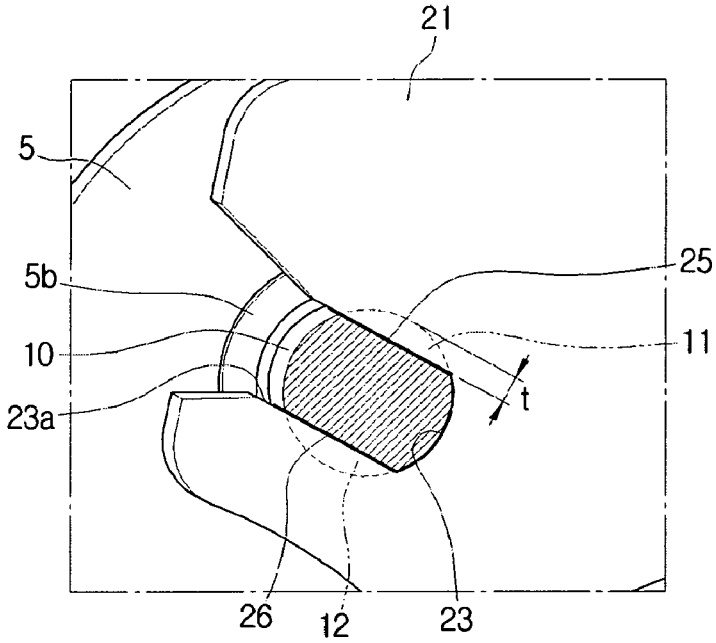
FIG. 3 is a partially cut-out, perspective view illustrating the photosensitive medium supporting apparatus of FIG. 1 taken along a line III-III in FIG. 1.

The first shaft supporting member 21 is provided with a first shaft supporting groove 23 into which the supporting shaft 10 can be inserted. The first shaft supporting groove 23 is formed in a shape corresponding to a section of the supporting shaft 10 and has an opening portion 23*a* through which the supporting shaft 10 can be inserted. The first shaft supporting groove 23 is provided with the fixing projection 25 that is inserted into the fixing groove 11 of the supporting shaft 10. In this embodiment, the supporting shaft 10 has the pair of fixing grooves 11 and 12, so the first supporting groove 23 is provided with a pair of fixing projections 25 and 26. Accordingly, at an upper side of the first shaft supporting groove 23 is formed the fixing projection 25 that is inserted into the fixing groove 11 formed at the upper side of the supporting shaft 10, and at a lower side of the first shaft supporting groove 23 is formed the second fixing projection 26 that is inserted into the second fixing groove 12 formed at the lower side of the supporting shaft 10. Therefore, when the supporting shaft 10 is inserted into the first shaft supporting groove 23 via the opening portion 23*a*, the pair of fixing projections 25 and 26 is inserted into the pair of the fixing grooves 11 and 12 as illustrated in FIG. 3.

Because when the supporting shaft 10 is inserted into the first shaft supporting groove 23 of the first shaft supporting member 21, the fixing projections 25 and 26 of the first shaft supporting groove 23 are inserted into the fixing grooves 11 and 12 of the supporting shaft 10, the supporting shaft 10 cannot rotate with respect to the first shaft supporting member 21 or move in the axial direction thereof.

The second shaft supporting member 22 is provided with a second shaft supporting groove 24 that supports the other portion of the supporting shaft 10 to project from the other end of the photosensitive medium 3. The other portion of the supporting shaft 10 to project from the other end of the photosensitive medium 3 has a substantially circular section so that the second shaft supporting groove 24 is formed in a shape into which the supporting shaft 10 with the circular section can be inserted. If the other portion of the supporting shaft 10 to be supported by the second shaft supporting groove 24 of the second shaft supporting member 22 is provided with fixing grooves as described above, the second shaft supporting groove 24 has a pair of fixing projections corresponding to the fixing grooves.

When assembling the photosensitive medium supporting apparatus 1 having the above-described structure, the supporting shaft 10 is inserted into the photosensitive medium 3 so that the fixing grooves 11 and 12 of the supporting shaft 10 is exposed outside one end of the photosensitive medium 3. After that, the fixing groove 11 of the supporting shaft 10 is aligned with the fixing projection 25 of the first shaft supporting groove 23, and the supporting shaft 10 with the photosensitive medium 3 is inserted into the first and second shaft supporting grooves 23 and 24 of the first and second shaft supporting members 21 and 22 so that the supporting shaft 10 is fixed to the first and second shaft supporting members 21 and 22. As a result, the supporting shaft 10 does not rotate with respect to the first and second shaft supporting members 21 and 22 or move in the axial direction of the photosensitive medium 3.

Figure 5:
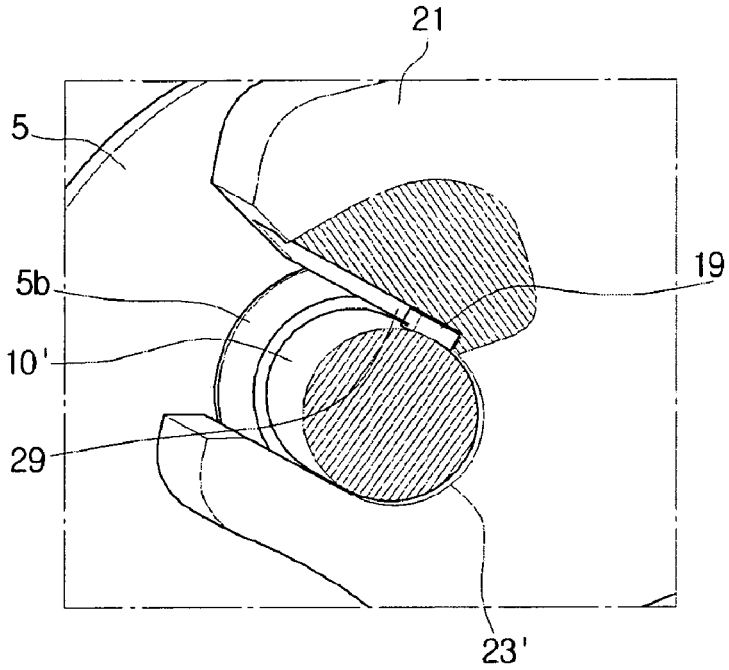
FIG. 5 is a partially cut-out, perspective view illustrating a supporting shaft with one fixing projection to be inserted into a first shaft supporting member with one fixing groove in a photosensitive medium supporting apparatus according to an embodiment of the present general inventive concept.

In above description, the fixing grooves 11 and 12 are formed at the supporting shaft 10, and the fixing projections 25 and 26 are formed at the first shaft supporting groove 23 of the first shaft supporting member 21. Alternatively, the fixing grooves 11 and 12 and fixing projections 25 and 26 may be formed at the opposite position. Accordingly, as illustrated in FIG. 5, a fixing projection 19 may be formed at a supporting shaft 10', and a fixing groove 29 may be formed at a first shaft supporting groove 23' of the first shaft supporting member 21. The fixing projection 19 formed at the supporting shaft 10' and the fixing groove 29 formed at the first shaft supporting groove 23' are similar to the fixing projection 25 and fixing groove 11 of the above described embodiment; therefore, detailed descriptions of those are omitted.

In above description, the photosensitive medium supporting apparatus 1 is used to support a rotation of the photosensitive medium 3. However, the photosensitive medium supporting apparatus 1 can be used as a rotation body supporting apparatus that supports a rotation of a rotation body having a similar structure to the photosensitive medium 3. The rotation body may include a charging roller, a developing roller, a toner supplying roller, a transferring roller, etc.

Hereinafter, a developing cartridge having a photosensitive medium supporting apparatus according to an embodiment of the present general inventive concept will be explained with reference to FIGS. 6 to 11.

Figure 8:
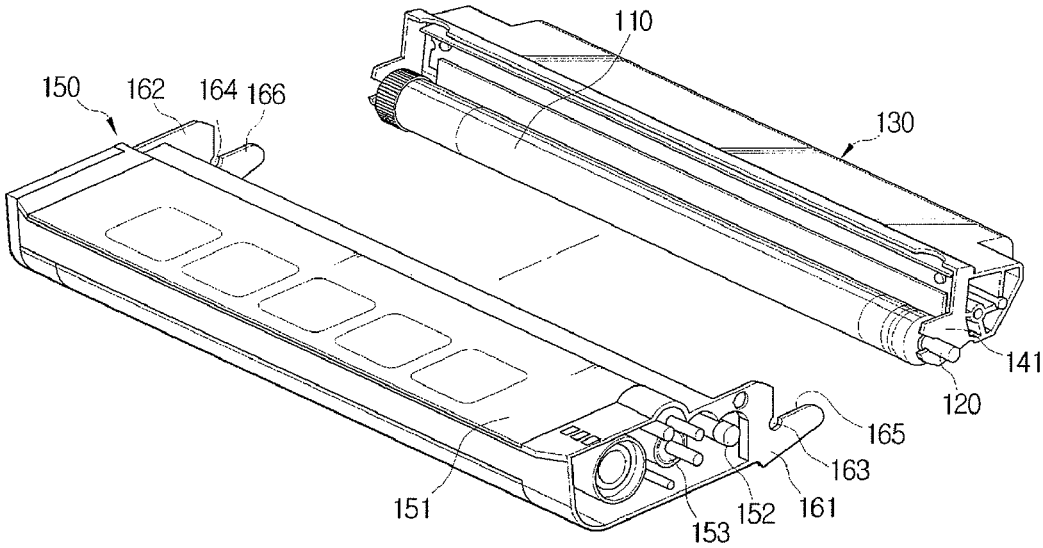
Figure 10:
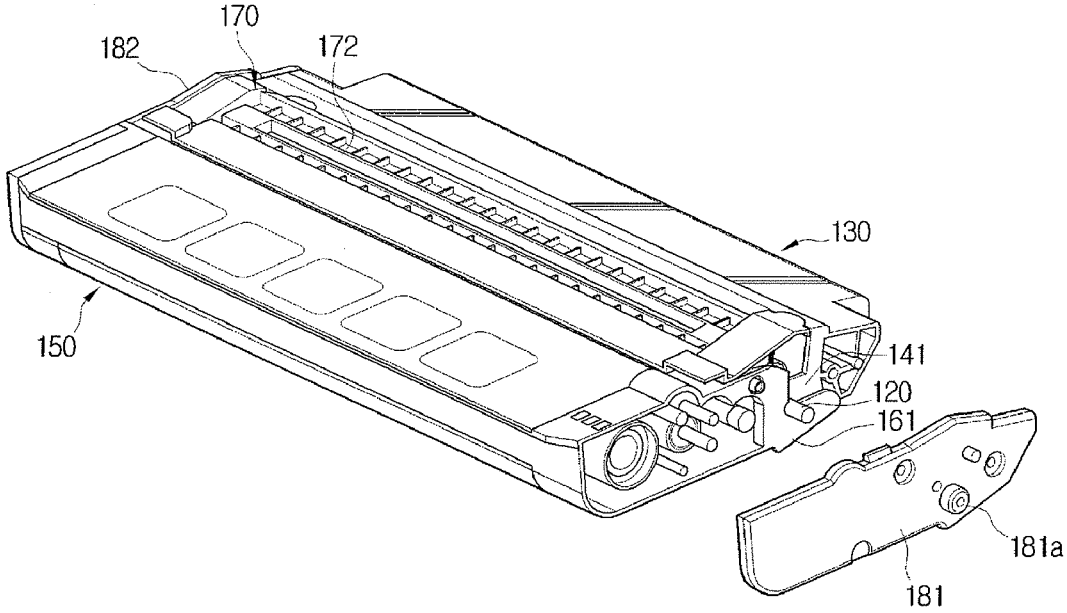
Figure 11:
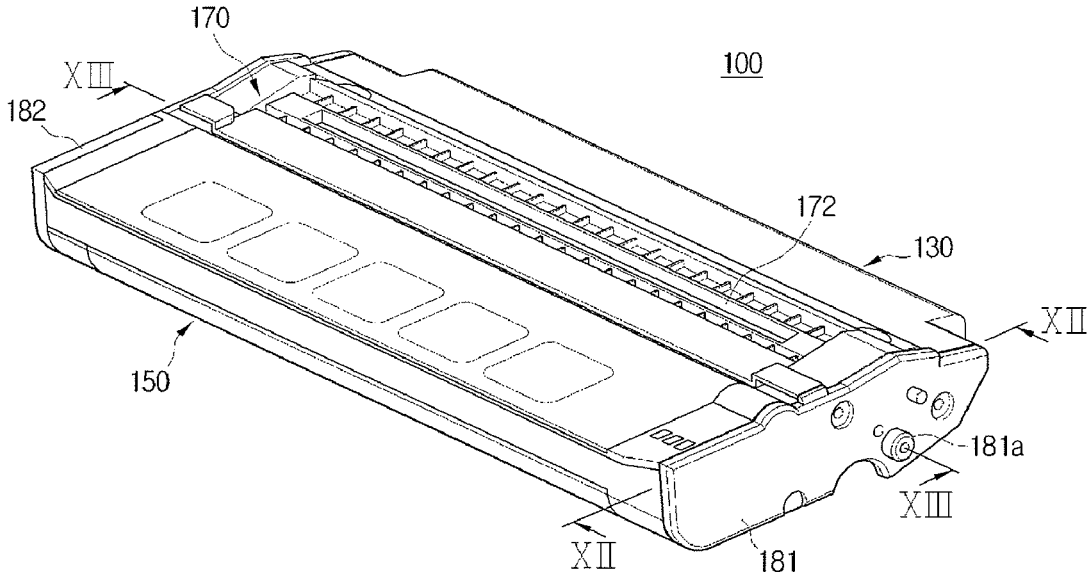

Referring to FIGS. 8 and 10, a developing cartridge 100 according to an embodiment of the present general inventive concept includes a photosensitive medium 110, a supporting shaft 120, a used toner collecting frame unit 130, a toner supply frame unit 150, a charging roller unit 170, a first side plate 181, and a second side plate 182.

The photosensitive medium 110 is disposed to rotate with respect to the supporting shaft 120, and predetermined electrostatic latent images are formed on a surface of the photosensitive medium 110. The photosensitive medium 110 is similar to the photosensitive medium 3 of the photosensitive medium supporting apparatus 1 as described above. Therefore, a detailed description thereof is omitted.

The supporting shaft 120 supports the photosensitive medium 110 to rotate with respect to the used toner collecting frame unit 130 and has fixing grooves 121 and 122. The supporting shaft 120 with the fixing grooves 121 and 122 is similar to the supporting shaft 10 of the photosensitive medium supporting apparatus 1 as described above. Therefore, a detailed description thereof is omitted.

The used toner collecting frame unit 130 removes and collects used toner to remain on the photosensitive medium 110, and includes a used toner collecting frame 131, a cleaning blade 132, and first and second shaft supporting members 141 and 142.

A used toner space 131*a* in which used toner to be removed from the photosensitive medium 110 is collected is disposed inside the used toner collecting frame 131. The cleaning blade 132 is disposed at a front side of the used toner collecting frame 131 to remove used toner from the photosensitive medium 110. The first and second shaft supporting members 141 and 142 are formed to support the supporting shaft 120 at both side surfaces of the used toner collecting frame 131. The first and second shaft supporting members 141 and 142 are provided with first and second shaft supporting grooves 143 and 144 into which the supporting shaft 120 is inserted. At the first shaft supporting groove 143 is formed a fixing projection 145 that is inserted into the fixing grooves 121 and 122 of the supporting shaft 120. The first and second shaft supporting grooves 143 and 144 are similar to the first and second shaft supporting grooves 23 and 24 of the photosensitive medium supporting apparatus 1 as described above. Therefore, detailed descriptions thereof are omitted.

The toner supply frame unit 150 stores a predetermined amount of toner, and supplies the stored toner to the photosensitive medium 110 to develop electrostatic latent images formed on the photosensitive medium 110 into visible images. The toner supply frame unit 150 is disposed opposite to the used toner collecting frame unit 130 with respect to the photosensitive medium 110, and includes a toner supply frame 151, a developing roller 152, a toner supplying roller 153, a toner regulating blade 154, and first and second coupling members 161 and 162.

A toner space 151*a* to store a predetermined amount of toner is disposed inside the toner supply frame 151. The developing roller 152 is rotatably disposed near a front side of the toner supply frame 151 to supply the photosensitive medium 110 with toner. The toner supplying roller 153 is rotatably disposed at a side of the developing roller 152 to supply the developing roller 152 with toner. The toner regulating blade 154 is disposed to contact the developing roller 152 at an upper side of the developing roller 152 so that the toner regulating blade 154 charges and regulates toner that is moved onto the developing roller 152 by the toner supplying roller 153 into a thin toner layer. An agitator may be disposed in the toner space 151*a* to agitate toner to be stored therein.

Figure 13:
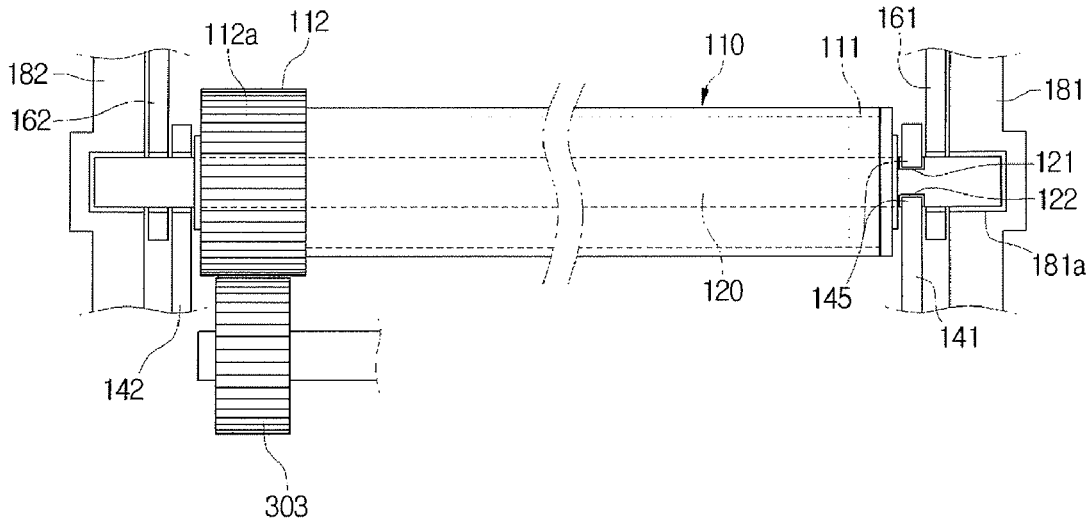
FIG. 13 is a sectional view illustrating the developing cartridge of FIG. 11 taken along a line XIII-XIII in FIG. 11.

The first and second coupling members 161 and 162 are disposed at both side surfaces of the toner supply frame 151 to support the supporting shaft 120. The first and second coupling members 161 and 162, as illustrated in FIG. 13, support the supporting shaft 120 outside the first and second shaft supporting members 141 and 142. First and second coupling grooves 153 and 164 are formed at the first and second coupling members 161 and 162, respectively. The first and second coupling grooves 163 and 164 are formed in a shape corresponding to the section of the supporting shaft 120 and have entrances 165 and 166 to allow the supporting shaft 120 to be inserted from a side direction. Therefore, the first and second coupling grooves 163 and 164 are inserted into the supporting shaft 120 via the entrances 165 and 166 so that the toner supply frame unit 150 is assembled with the used toner collecting frame unit 130, thereby locating in a predetermined distance from the photosensitive medium 110.

The charging roller unit 170 supports a charging roller 173 to charge the photosensitive medium 110, and includes the charging roller 173 and a charging roller frame 171. The charging roller 173 may be hinge-connected to the charging roller frame 171. Furthermore, a charging roller cleaning member (not illustrated) to clean up a surface of the charging roller 173 and a charge eliminating roller (not illustrated) to eliminate voltage remaining on the photosensitive medium 110 may be disposed at the charging roller frame 171. The charging roller frame 171 is provided with a laser beam hole 172 through which laser beam to be emitted from the light exposing unit 380 (FIG. 14) passes.

Figure 12:
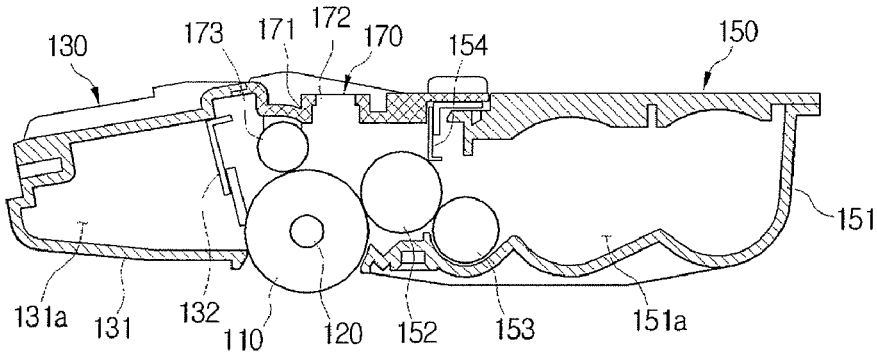
FIG. 12 is a sectional view illustrating the developing cartridge of FIG. 11 taken along a line XII-XII in FIG. 11.

The first and second side plates 181 and 182 are disposed at both sides of the toner supply frame unit 150 and the used toner collecting frame unit 130, which locate at both sides with respect to the photosensitive medium 110, and fix the toner supply frame unit 150 and the used toner collecting frame unit 130 not to move with respect to each other. As illustrated in FIG. 13, a supporting shaft hole 181*a* into which a respective end of the supporting shaft 120 is inserted is formed at each of the first and second side plates 181 and 182. Also, at each of the first and second side plates 181 and 182 may be formed a developing roller shaft hole to support a shaft of the developing roller 152 (FIG. 12) and a toner supplying roller shaft hole to support a shaft of the toner supplying roller 153 (FIG. 12).

Hereinafter, an operation of a developing cartridge 100 with an above-described structure will be explained with reference to FIG. 12.

Figure 14:
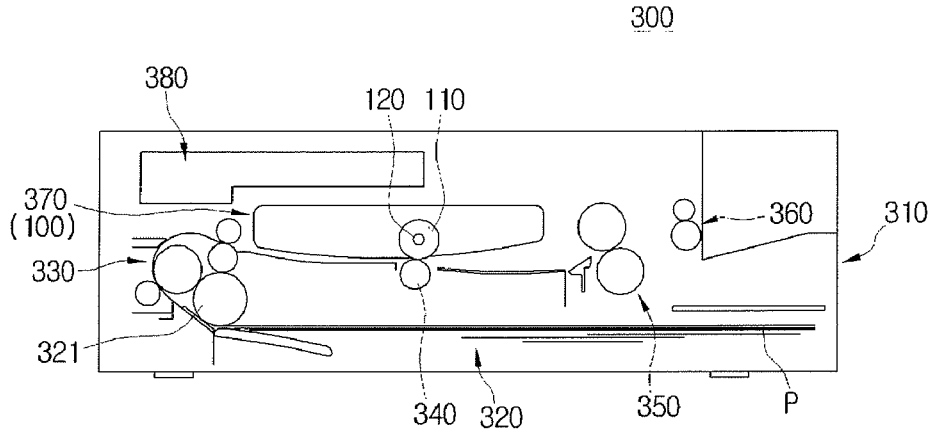
FIG. 14 is a sectional view schematically illustrating an image forming apparatus with a developing cartridge according to an embodiment of the present general inventive concept.
Figure 15:
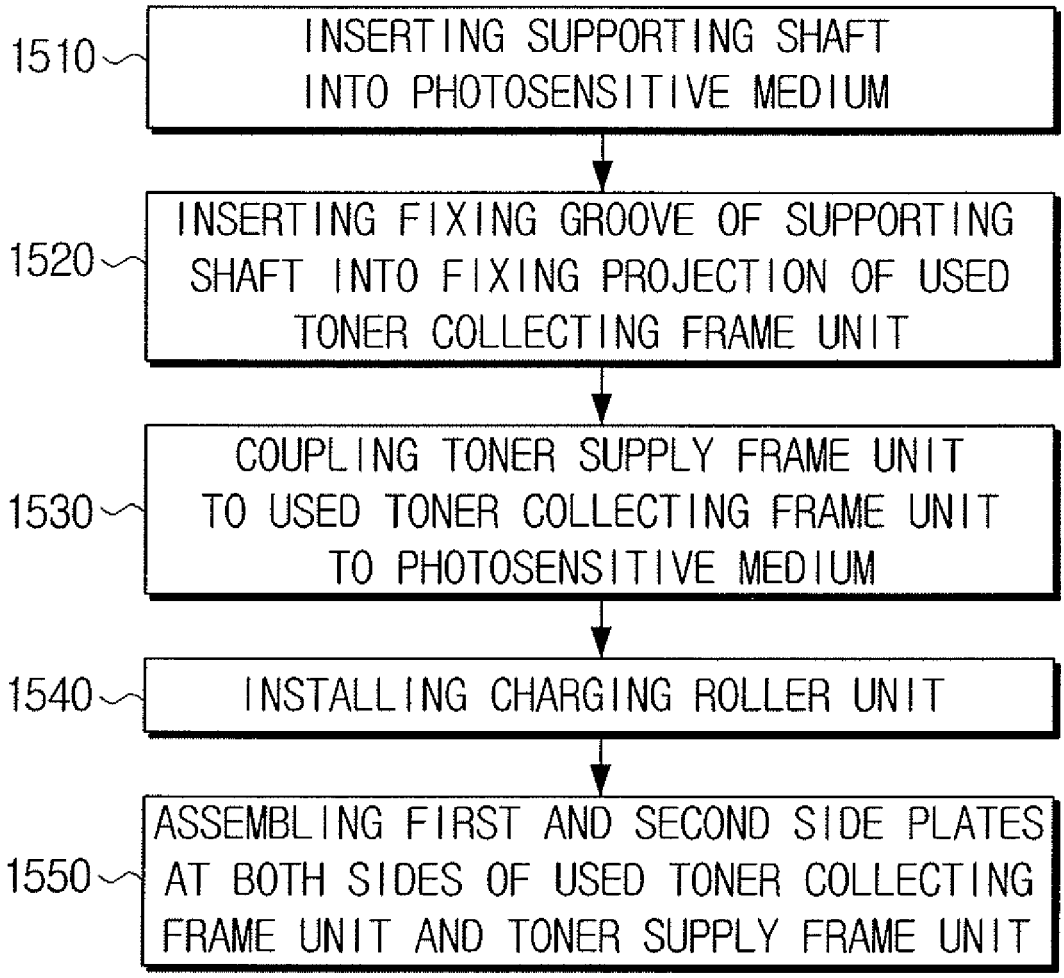
FIG. 15 illustrates a method of assembling a developing cartridge of an image forming apparatus according to an embodiment of the present general inventive concept.
Figure 16:
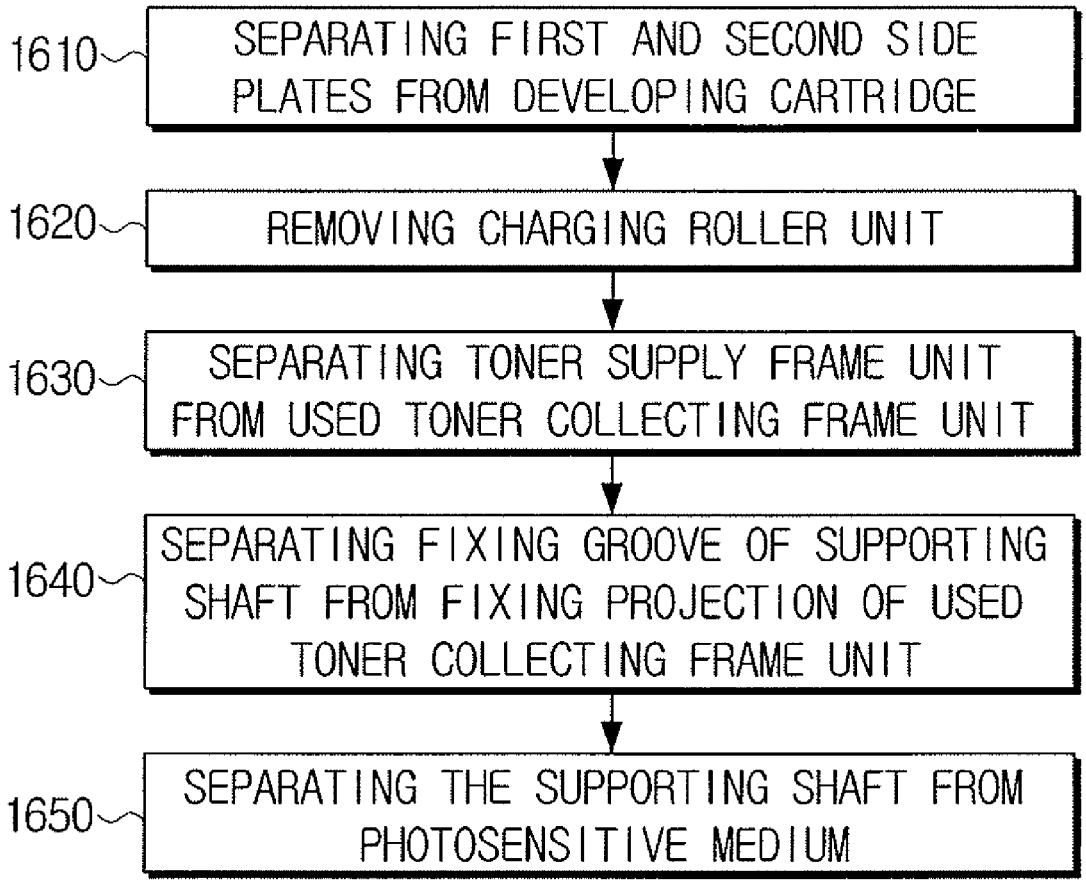
FIG. 16 illustrates a method of disassembling a developing cartridge of an image forming apparatus according to an embodiment of the present general inventive concept.

Toner to be stored at the toner space 151a of the toner supply frame 151 is carried to the developing roller 152 by the toner supplying roller 153. When the developing roller 152 rotates, the toner that is moved onto the developing roller 152 is regulated into a thin toner layer while passing beneath the toner regulating blade 154. When the developing roller 152 continues to rotate, the thin toner layer is moved to face the photosensitive medium 110. Then, toner to form the toner layer on the developing roller 152 is moved to the photosensitive medium 110. The toner to be moved onto the photosensitive medium 110 develops the electrostatic latent images into visible images. The visible images that are formed on the photosensitive medium 110 are transferred onto a printing medium by a transferring roller 340 (FIG. 14). Used toner that remains on the photosensitive medium 110 after the visible images are transferred onto the printing medium is removed by the cleaning blade 132 and collected in the used toner space 131*a* of the used toner collecting frame 131.

After that, the photosensitive medium 110 having used toner removed is re-charged to a predetermined voltage by the charging roller 173, and the above procedure is repeated for visible images to be formed on the photosensitive medium 110.

In the developing cartridge 100 according to an embodiment of the present general inventive concept, as illustrated in FIGS. 8 and 13, because the fixing grooves 121 and 122 of the supporting shaft 120 are inserted into the fixing projections 145 of the first shaft supporting member 141 of the used toner collecting frame unit 130, when the photosensitive medium 110 rotates with respect to the supporting shaft 120, the supporting shaft 120 does not rotate with respect to the first and second shaft supporting members 141 and 142 of the used toner collecting frame 131 or move in the axial direction of the photosensitive medium 110.

Hereinafter, an assembly procedure of a developing cartridge 100 according to an embodiment of the present general inventive concept having the above-described structure will be explained with reference to FIGS. 6 to 11 and FIG. 15.

Figure 6:
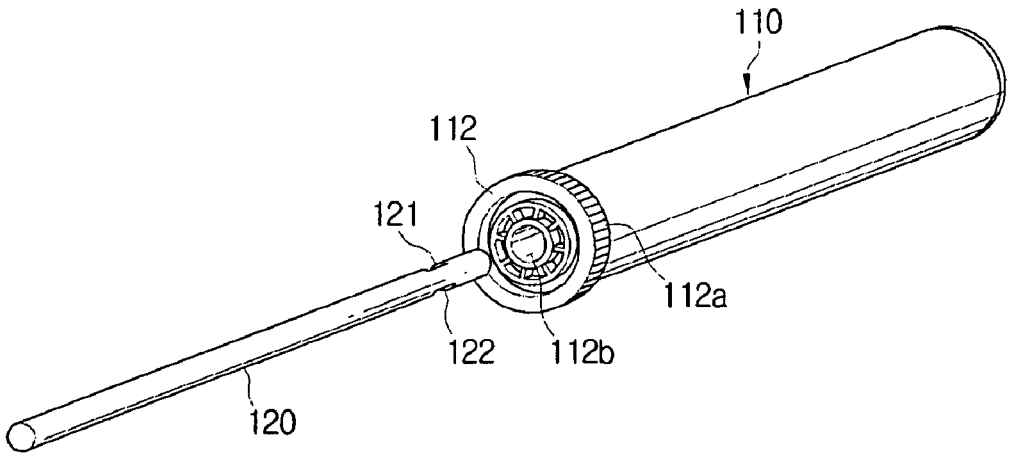
FIGS. 6 to 11 are perspective views illustrating a method to assemble a developing cartridge according to an embodiment of the present general inventive concept.
Figure 7:
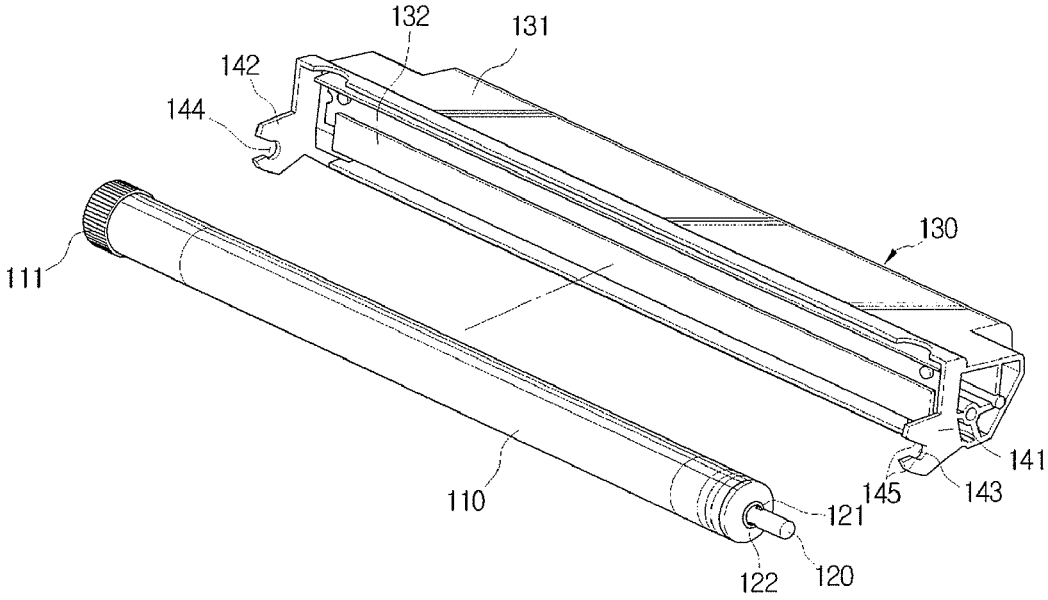

First, the supporting shaft 120 is inserted into the through hole 112*b* of the photosensitive medium 110 (operation 1510). A side of the supporting shaft 120 on which the fixing grooves 121 and 122 are formed is inserted into the gear formed second flange 112 of the photosensitive medium 110 as illustrated in FIG. 6 so that the fixing grooves 121 and 122 of the supporting shaft 120 are exposed outside the first flange 111 with no gear as illustrated in FIG. 7.

The supporting shaft 120 coupled with the photosensitive medium 110 is inserted into the first and second shaft supporting grooves 143 and 144 of the first and second shaft supporting members 141 and 142 of the used toner collecting frame unit 130. The fixing grooves 121 and 122 of the supporting shaft 120 are aligned with the fixing projections 145 formed at the first shaft supporting groove 143 of the first shaft supporting member 141, and then, the supporting shaft 120 is inserted through the opening portions of the first and second shaft supporting grooves 143 and 144 of the first and second shaft supporting members 141 and 142 (operation 1520). As illustrated in FIG. 8, when the supporting shaft 120 is completely inserted into the first and second shaft supporting grooves 143 and 144, the fixing grooves 121 and 122 formed at the supporting shaft 120 and the fixing projections 145 formed at the first shaft supporting groove 143 prevent the supporting shaft 120 from rotating or moving in the axial direction of the photosensitive medium 110.

Then, the toner supply frame unit 150 is coupled with the used toner collecting frame unit 130 (operation 1530). Accordingly, the first and second coupling grooves 163 and 164 formed at the first and second coupling members 161 and 162 of the toner supply frame unit 150 may be inserted into the supporting shaft 120 outside the first and second shaft supporting members 141 and 142 of the used toner collecting frame unit 130 (FIG. 13). As a result, the toner supply frame unit 150 is fixed to a position predetermined with respect to the photosensitive medium 110 as illustrated in FIG. 9.

Figure 9:
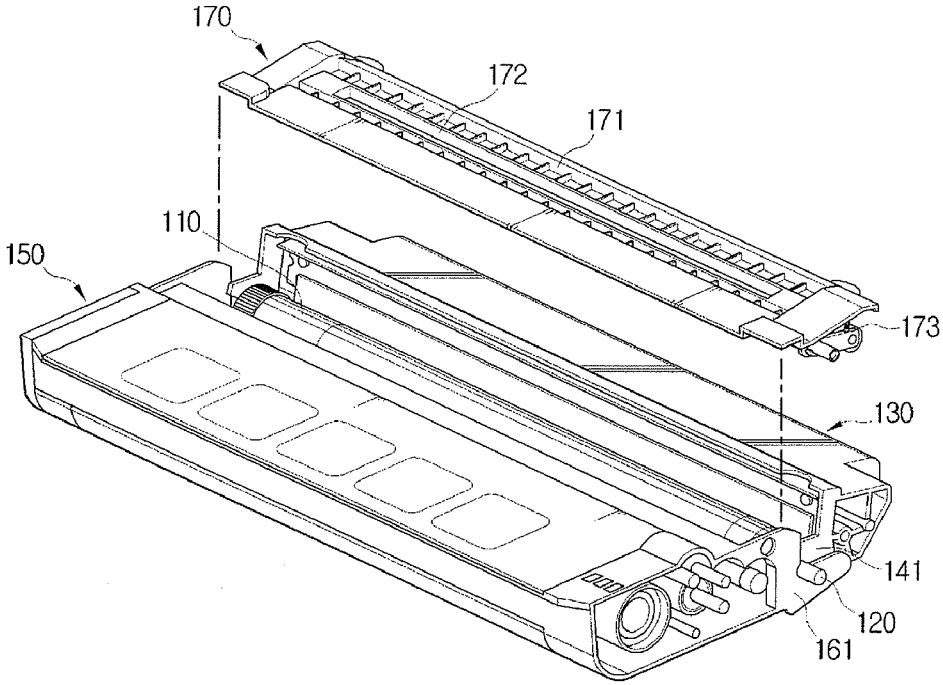

As illustrated in FIG. 9, the charging roller unit 170 is disposed above the photosensitive medium 110 between the toner supply frame unit 150 and the used toner collecting frame unit 130 (operation 1540). At least one fixing portion (not illustrated) to fix the charging roller unit 170 may be formed at the used toner collecting frame 131 or the toner supply frame 151.

As illustrated in FIG. 10, the first and second side plates 181 and 182 are assembled to the left and right sides of the toner supply frame unit 150 and the used toner collecting frame unit 130 (operation 1550) so that the assembly of the developing cartridge 100 is completed. When assembling the first and second side plates 181 and 182, each of the both ends of the supporting shaft 120 is inserted into the supporting shaft hole 181*a* formed on each of the first and second side plates 181 and 182. Also, if the first and second side plates 181 and 182 have shaft holes to support shafts of the developing roller 152 and the toner supplying roller 153, each of the shaft holes is aligned and assembled with each the shafts of the developing roller 152 and the toner supplying roller 153.

When disassembling a developing cartridge 100 according to an embodiment of the present general inventive concept that is assembled through the above-described procedure, the disassembly of the developing cartridge 100 is performed in the opposite order of the assembly procedure. Referring to FIGS. 6-11 and 16, in operation 1610, the first and second side plates 181 and 182 are disassembled from the left and right sides of the toner supply frame unit 150 and the used toner collecting frame unit 130. In operation 1620, the charging roller unit 170 disposed above the photosensitive medium 110 between the toner supply frame unit 150 and the used toner collecting frame unit 130 is removed therefrom. In operation 1630, the toner supply frame unit 150 is separated from the used toner collecting frame unit 130. In operation 1640, the fixing grooves 121 and 122 of the supporting shaft 120 are separated from the fixing projections 145 of the used toner collecting frame unit 130 so that the supporting shaft 120 with the photosensitive medium 110 is separated from the used toner collecting frame unit 130. In operation 1650, the supporting shaft 120 is separated from the photosensitive medium 110 to complete the disassembly procedure.

In the above description, the developing cartridge 100 is constituted of the used toner collecting frame unit 130, the toner supply frame unit 150, and the charging roller unit 170. In other words, the frame of the developing cartridge 100 is formed of the used toner collecting frame 131, the toner supply frame 151, the charging roller frame 171, and the first and second side plates 181 and 182. Alternatively, although not illustrated, the developing cartridge 100 may use an integrally formed frame. Accordingly, first and second shaft supporting members to support a supporting shaft are disposed to face each other inside the integrally formed frame. Also, a photosensitive medium hole is formed at a bottom surface of the frame so that some portion of the photosensitive medium is exposed through the photosensitive medium hole. The developing cartridge is similar to the developing cartridge 100 according to the above-described embodiment except that the frame is integrally formed. Therefore, a detailed description thereof is omitted.

Hereinafter, an image forming apparatus having a developing cartridge according to an embodiment of the present general inventive concept will be explained with reference to FIG. 14.

Referring to FIG. 14, an image forming apparatus 300 having a developing cartridge according to an embodiment of the present general inventive concept includes a main body cover 310, a printing medium feeding unit 320, a conveying roller unit 330, a light exposure unit 380, a developing cartridge 370, a fixing unit 350, and a discharging unit 360.

The main body cover 310 forms an appearance of the image forming apparatus 300. Inside the main body cover 310 are disposed the printing medium feeding unit 320, the conveying roller unit 330, the light exposure unit 380, the developing cartridge 370, the fixing unit 340, and the discharging unit 360.

The printing medium feeding unit 320 is disposed at a lowest side inside the main body cover 310, and holds a plurality of printing media P. A pickup roller 321 picks up the stored printing media P one by one to feed, and is disposed at a front end of the printing medium feeding unit 320.

The conveying roller unit 330 includes at least a pair of conveying rollers, and coveys a printing medium P to be picked up by the printing medium feeding unit 320 between the transferring roller 340 and a photosensitive medium 110.

The light exposure unit 380 is disposed above the developing cartridge 370, and emits laser beam corresponding to printing data to the photosensitive medium 110 of the developing cartridge 370.

The developing cartridge 370 supplies toner to electrostatic latent images formed by the laser beam emitted from the light exposure unit 380, thereby developing the electrostatic latent images into toner images. The developing cartridge 370 is detachably disposed inside the main body cover 310 of the image forming apparatus 300. Therefore, when the developing cartridge 370 is disposed inside the image forming apparatus 300, as illustrated in FIG. 13, the gear 112*a* of the photosensitive medium 110 is meshed with the drive gear 303 to be disposed inside the main body cover 310. The structure of the developing cartridge 370 is similar to the developing cartridge 100 according to an embodiment of the present general inventive concept as described above. Therefore, a detailed description thereof is omitted.

The transferring roller 340 is rotatably disposed to contact the photosensitive medium 110 of the developing cartridge 370 below the developing cartridge 370, and transfers toner images formed on the photosensitive medium 110 onto a printing medium P conveyed from the printing medium feeding unit 320.

The fixing unit 350 is disposed downstream the transferring roller 340, and includes a pressure roller and a heat roller. The fixing unit 350 applies heat and pressure to the printing medium P to pass through between the heat and pressure rollers, thereby fixing the toner images onto the printing medium P.

The discharging unit 360 discharges the printing medium P to outside the image forming apparatus 300 after the printing medium P passes through the fixing unit 350 and the images are fixed onto the printing medium P.

Hereinafter, an operation of an image forming apparatus 300 according to an embodiment of the present general inventive concept having the above-described structure will be explained with reference to FIG. 14.

When receiving a printing order, the image forming apparatus 300 applies voltage to the charging roller 173 (FIG. 12) of the developing cartridge 370 so as to charge the surface of the photosensitive medium 110 by a predetermined voltage.

After that, the image forming apparatus 300 operates a drive motor (not illustrated) to rotate the drive gear 303 (FIG. 13). When the drive gear 303 rotates, the gear 112*a* of the photosensitive medium 110 meshed with the drive gear 303 rotates so that the photosensitive medium 110 rotates. Although the photosensitive medium 110 rotates, the supporting shaft 120 does not rotate together with the photosensitive medium 110 or move in the axial direction thereof because the fixing grooves 121 and 122 of the supporting shaft 120 are inserted into the fixing projections 145 of the first shaft supporting member 141.

Furthermore, the image forming apparatus 300 operates the light exposure unit 380 to emit laser beam corresponding to printing data. The laser beam emitted from the light exposure unit 380 enters the photosensitive medium 110 through the laser beam hole 172 formed at the charging roller frame 171 (FIG. 12) of the developing cartridge 370 to form electrostatic latent images corresponding to the printing data on the photosensitive medium 110 charged by the charging roller 173.

When the photosensitive medium 110 continues to rotate due to the drive gear 303, the electrostatic latent images on the photosensitive medium 110 moves to a position to face the developing roller 152. Then, toner of the toner layer formed on the developing roller 152 moves to the surface of the photosensitive medium 110 to develop the electrostatic latent images into toner images.

Also, when receiving the printing order, the printing medium feeding unit 320 picks up a printing medium P from the stored printing media, and feeds the printing medium P to the conveying roller unit 330. The conveying roller unit 330 causes the picked up printing medium P to enter between the transferring roller 340 and the photosensitive medium 110 of the developing cartridge 370.

When the printing medium P enters between the transferring roller 340 and the photosensitive medium 110 of the developing cartridge 370, the toner images formed on the rotating photosensitive medium 110 are transferred onto the printing medium P.

When the photosensitive medium 110 continues to rotate, used toner that remains on the surface of the photosensitive medium 110 after the toner images are transferred onto the printing medium P is removed by the cleaning blade 132. The used toner to be removed from the photosensitive medium 110 is collected in the used toner space 131*a* formed in the used toner collecting frame 131.

When the photosensitive medium 110 continues to rotate, a portion of the photosensitive medium 110 from which the used toner is removed faces to the charging roller 173 so that the portion of the photosensitive medium 110 is re-charged by the charging roller 173.

The charged photosensitive medium 110 repeats the above procedure to transfer toner images onto a printing medium P.

The printing medium P onto which the toner images are transferred from the photosensitive medium 110 of the developing cartridge 370 is conveyed to the fixing unit 350. When the printing medium P passes through between the pressure and heat rollers of the fixing unit 350, the toner images are fixed onto the printing medium P.

The printing medium P onto which the toner images are fixed is discharged to outside the image forming apparatus 300 by the discharging unit 360.

With a photosensitive medium supporting apparatus, a developing cartridge, and an image forming apparatus according to an embodiment of the present general inventive concept as described above, because fixing projections of a first shaft supporting members are inserted into fixing grooves formed at a supporting shaft, the supporting shaft is prevented from rotating or moving in an axial direction thereof. Therefore, separate portions to prevent the supporting shaft from rotating are not required, so that a number of parts may decrease.

With a photosensitive medium supporting apparatus and a developing cartridge according to an embodiment of the present general inventive concept, fixing grooves of a supporting shaft and fixing projections of a shaft supporting member can perform two functions as the prevention of rotation of a supporting shaft and the prevention of an axial direction movement of the supporting shaft, which may decrease manufacturing costs as compared to the conventional photosensitive medium supporting apparatus and developing cartridge.

Furthermore, with a photosensitive medium supporting apparatus and a developing cartridge according to the present general inventive concept, a supporting shaft is assembled with shaft supporting members by merely inserting fixing grooves of the supporting shaft into fixing projections of the shaft supporting members, which makes assembly easy. Therefore, assembly time may decrease.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A photosensitive medium supporting apparatus usable with a developing cartridge, the apparatus comprising:

a supporting shaft to rotatably support a photosensitive medium and having one of a fixing groove and a fixing projection formed at one portion of the supporting shaft that projects from one end of the photosensitive medium;

a first shaft supporting member integrally formed with the supporting apparatus to support the one portion of the supporting shaft that projects from the one end of the photosensitive medium and having one of a fixing projection and a fixing groove that is inserted into the fixing groove or the fixing projection of the supporting shaft; and a second shaft supporting member to support the other portion of the supporting shaft that projects from the other end of the photosensitive medium.

2. The photosensitive medium supporting apparatus of claim 1, wherein the supporting shaft further comprises:

one of a second fixing groove and a second fixing projection formed below the fixing groove or the fixing projection; and the first shaft supporting member further comprises:

one of a second fixing projection and a second fixing groove that is inserted into the second fixing groove or the second fixing projection of the supporting shaft.

3. The photosensitive medium supporting apparatus of claim 1, wherein the first and second shaft supporting members are disposed in a developing cartridge.

4. A developing cartridge usable with an image forming apparatus, the developing cartridge comprising:

a supporting shaft to rotatably support a photosensitive medium and having a fixing groove formed at one portion of the supporting shaft that projects from one end of the photosensitive medium;

a frame having a photosensitive medium hole through which some portion of the photosensitive medium is exposed;

a first shaft supporting member integrally formed with the frame and extending therefrom to support the one portion of the supporting shaft that projects from the one end of the photosensitive medium and having a fixing projection integrally formed thereon that is inserted into the fixing groove of the supporting shaft; and a second shaft supporting member disposed inside the frame to face the first shaft supporting member to support an other portion of the supporting shaft that projects from an other end of the photosensitive medium.

5. The developing cartridge of the image forming apparatus of claim 4, further comprising:

a second fixing groove formed at the supporting shaft; and a second fixing projection inserted into the second fixing groove.

6. The developing cartridge of the image orming apparatus of claim 4, wherein the photosensitive medium comprises;

a photosensitive drum formed in a substantially hollow cylindrical shape;

a first flange disposed at one end of the photosensitive drum, and having a through hole into which the supporting shaft is inserted; and a second flange disposed at an other end of the photosensitive drum, and having a gear formed on an outer circumferential surface of the second flange and a through hole into which the supporting shaft is inserted.

7. The developing cartridge of the image forming apparatus of claim 6, wherein each of the first and second flanges comprises:

a projection portion formed on a side of each of the first and second flanges to contact each of the first and second shaft supporting members.

8. A developing cartridge of an image forming apparatus, comprising:

a supporting shaft to rotatably support a photosensitive medium and having a fixing groove formed at one portion of the supporting shaft that projects from one end of the photosensitive medium;

a used toner collecting frame unit having first and second shaft supporting members that are formed to support both portions of the supporting shaft to project from both ends of the photosensitive medium;

a fixing projection extending from the first shaft supporting member to be inserted into the fixing groove of the supporting shaft;

a toner supply frame unit disposed opposite to the used toner collecting frame unit with respect to the photosensitive medium; and first and second side plates disposed at both sides of the used toner collecting frame unit and the toner supply frame unit.

9. The developing cartridge of the image forming apparatus of claim 8, further comprising:

a second fixing groove formed at the supporting shaft; and a second fixing projection inserted into the second fixing groove.

10. The developing cartridge of the image forming apparatus of claim 8, wherein the photosensitive medium comprises;

a photosensitive drum formed in a substantially hollow cylindrical shape;

a first flange disposed at one end of the photosensitive drum, and having a through hole into which the supporting shaft is inserted; and a second flange disposed at the other end of the photosensitive drum, and having a gear formed on an outer circumferential surface of the second flange and a through hole into which the supporting shaft is inserted.

11. The developing cartridge of the image forming apparatus of claim 10, wherein each of the first and second flanges comprises:

a projection portion formed on a side of each of the first and second flanges to contact each of the first and second shaft supporting members.

12. The developing cartridge of the image forming apparatus of claim 8, wherein the toner supply frame unit comprises:

first and second coupling members that are formed to support the both portions of the supporting shaft to project from both ends of the photosensitive medium outside the first and second shaft supporting members of the used toner collecting frame unit.

13. The developing cartridge of the image forming apparatus of claim 8, further comprising:

a charging roller unit disposed above the photosensitive medium between the used toner collecting frame unit and the toner supply frame unit.

14. An image forming apparatus, comprising:

a printing medium feeding unit to supply a printing medium; and a developing cartridge to form images corresponding to printing data, the developing cartridge comprising;

a supporting shaft to rotatably support a photosensitive medium and having a fixing groove formed at one portion of the supporting shaft that projects from one end of the photosensitive medium;

a frame having a photosensitive medium hole through which a portion of the photosensitive medium is exposed;

a first shaft supporting member disposed inside the frame to support the one portion of the supporting shaft that projects from the one end of the photosensitive medium and having a fixing projection integrally formed thereon that is inserted into the fixing groove of the supporting shaft; and a second shaft supporting member disposed inside the frame to face the first shaft supporting member to support an other portion of the supporting shaft that projects from an other end of the photosensitive medium;

a transferring roller rotatably disposed to contact the photosensitive medium to transfer the image formed on the photosensitive medium onto a printing medium supplied from the printing medium feeding unit; and a discharging unit to discharge the printing medium having the images formed thereon.

15. A method to assemble a developing cartridge of an image forming apparatus, the method comprising:

inserting a supporting shaft into a photosensitive medium so that a fixing groove of the supporting shaft is exposed outside one end of the photosensitive medium;

inserting the fixing groove of the supporting shaft into a fixing projection integrally formed with the toner collecting frame unit so that the supporting shaft with the photosensitive medium is assembled with the used toner collecting frame unit;

installing a toner supply frame unit opposite to the used toner collecting frame unit with respect to the photosensitive medium;

installing a charging roller unit above the photosensitive medium between the used toner collecting frame unit and the toner supply frame unit; and assembling first and second side plates at both sides of the used toner collecting frame unit and the toner supply frame unit.

16. A method to disassemble a developing cartridge of an image forming apparatus, the method comprising:

separating first and second side plates from the developing cartridge;

separating a charging roller unit;

separating a toner supply frame unit from a used toner collecting frame unit;

separating a fixing groove of a supporting shaft from a fixing projection of the used toner collecting frame unit so that the supporting shaft with a photosensitive medium is separated from the used toner collecting frame unit; and separating the supporting shaft from the photosensitive medium.

17. A photosensitive medium for a developing cartridge detachably mounted to an image forming apparatus, the photosensitive medium comprising;

a supporting shaft to rotatably support the photosensitive medium, to project from both ends of the photosensitive medium, and having a fixing groove, wherein the fixing groove is formed at one portion of the supporting shaft that projects from one end of the photosensitive medium to be inserted into a fixing projection of a first shaft supporting member disposed at the developing cartridge.

18. The photosensitive medium of claim 17, wherein the supporting shaft further comprises:

a second fixing groove; and the first shaft supporting member further comprises:

a second fixing projection that is inserted into the second fixing groove.

19. A supporting shaft usable with a developing cartridge detachably mounted to an image forming apparatus, comprising:

two portions disposed on opposite ends of the supporting shaft to project from two ends of a photosensitive medium of the developing cartridge and to be supported by first and second shaft supporting members that are disposed at the developing cartridge; and a fixing groove formed at one portion of the supporting shaft that projects from one end of the photosensitive medium to be coupled to a fixing projection integrally formed with the first shaft supporting member;

wherein when the fixing groove of the supporting shaft is coupled to the fixing projection of the first shaft supporting member, the supporting shaft is fixed with respect to the first and second shaft supporting members to rotatably support the photosensitive medium.

20. The supporting shaft of claim 19, wherein the supporting shaft further comprises:

a second fixing groove; and the first shaft supporting member further comprises:

a second fixing projection that is inserted into the second fixing groove.

21. A frame for a developing cartridge detachably mounted to an image forming apparatus, the frame comprising:

first and second shaft supporting members to support a supporting shaft, wherein the supporting shaft projects from both ends of a photosensitive medium of the developing cartridge and has a fixing groove formed at one portion of the supporting shaft to project from one end of the photosensitive medium, and wherein the first shaft supporting member has a fixing projection formed to be inserted into the fixing groove of the supporting shaft.

22. The frame of claim 21, wherein the supporting shaft further comprises:

a second fixing groove; and the first shaft supporting member further comprises:

a second fixing projection that is inserted into the second fixing groove.

23. A developing apparatus usable with an image forming apparatus including a toner collecting frame having at least one frame fixing projection integrally formed with the toner collecting frame, comprising:

a photosensitive medium having opposite ends;

a supporting shaft to rotatably support the photosensitive medium and having two end portions, each of the two end portions of the supporting shaft extending pass the opposite ends of the photosensitive medium, respectively; and at least one of the two end portions having one of at least one shaft fixing groove and at least one shaft fixing projection to interconnect the at least one frame fixing projection and frame supporting groove of the toner collecting frame.

24. The developing apparatus of claim 23, wherein:

the shaft fixing groove has a first circumference being less than a circumference of the at least one of the two end portions; and the toner collecting frame includes the one fixing projection corresponding to the circumference of the shaft fixing groove.

25. The developing apparatus of claim 23, wherein:

two end portions of the supporting shaft each include one shaft fixing groove; and the toner collecting frame includes at least one frame fixing projection corresponding to at least one of the shaft fixing grooves.

26. The developing apparatus of claim 23, wherein:

at least one end portion of the supporting shaft includes a pair of shaft fixing grooves; and the toner collecting frame includes a pair of frame fixing projections corresponding to the pair of shaft fixing grooves.

27. The developing apparatus of claim 23, wherein:

two end portions of the supporting shaft each include one shaft fixing groove; and the toner collecting frame includes at least one frame fixing projection corresponding to each of the shaft fixing grooves.

28. A developing cartridge, comprising:

a toner collecting frame including at least one of a frame fixing groove and a frame fixing projection and including a shaft supporting member coupled to the toner collecting frame and having at least one of a shaft fixing projection integrally formed with the toner collecting frame and a shaft fixing groove; and a developing apparatus, comprising:

a photosensitive medium having opposite ends;

a supporting shaft having two end portions and to rotatably support the photosensitive medium, each of the two end portions of the supporting shaft extending pass the opposite ends of the photosensitive medium, respectively; and at least one of the two end portions having a second shaft fixing groove and a second fixing projection to interconnect with the at least one of the frame fixing groove and the frame fixing projection of the toner collecting frame.

29. A developing apparatus, comprising:

a photosensitive drum having a gear formed on a surface thereof and a hole formed therein in a rotation axis thereof;

a shaft rotatably inserted in the hole, having a first end having a groove, and having a second end; and a frame including a first shaft supporting member, having a first supporting groove to correspond to the groove of the first end and having a second supporting groove to correspond to the second end.

30. A developing apparatus of claim 29, wherein:

the first supporting groove has a first width; and the second supporting groove has a second width wider than the first supporting groove.

31. A developing apparatus of claim 29, wherein the first end has a portion to correspond to the groove, the portion of the first end has a first thickness, and the second end has a second thickness thicker than the first thickness.

32. A developing apparatus of claim 31, wherein the gear formed on the photosensitive drum is disposed closer to the second end than the first end.

* * * * *